US005800211A

United States Patent [19]

Stabile et al.

[11] Patent Number: 5,800,211

[45] Date of Patent: Sep. 1, 1998

[54] SNAP TOGETHER CATV CONNECTOR FOR INDOOR USE

[75] Inventors: David J. Stabile, Horseheads; Ronald P. Locati, Elmira, both of N.Y.

[73] Assignee: Augat Inc., Mansfield, Mass.

[21] Appl. No.: 671,128

[22] Filed: Jun. 24, 1996

[51] Int. Cl.[6] ..... H01R 13/58

[52] U.S. Cl. ..... 439/578

[58] Field of Search ..... 439/578, 583, 439/584

[56] References Cited

U.S. PATENT DOCUMENTS

| | | | |
|---|---|---|---|
| 4,720,275 | 1/1988 | Swart et al. | 439/725 |
| 4,834,675 | 5/1989 | Samchisen | 439/578 |
| 4,902,246 | 2/1990 | Samchisen | 439/578 |
| 5,470,257 | 11/1995 | Szegda | 439/578 |
| 5,599,202 | 2/1997 | Key | 439/459 |

*Primary Examiner*—J. J. Swann

*Attorney, Agent, or Firm*—Weingarten, Schurgin, Gagnebin & Hayes LLP

[57] ABSTRACT

A low-cost snap together coaxial cable connector for indoor use. The connector includes a central post made of an electrically conductive material, with the remaining parts made from a low cost non-conductive material such as plastic. Since the conductor is intended for internal use only, there are no o-rings required. The connector meets or exceeds Society of Cable and Television Engineers (SCTE) standards. The connector can be assembled by a relatively unskilled worker and is compatible with existing assembly tools.

10 Claims, 3 Drawing Sheets

SNAP TOGETHER CATV CONNECTOR FOR INDOOR USE

FIELD OF THE INVENTION

The present invention relates generally to electrical connectors and more particularly to coaxial cable connectors.

BACKGROUND OF THE INVENTION

Coaxial cable connectors are known in the art, and typically include a body, nut and post made of electrically conductive materials. The coaxial connectors further include an electrical insulator to isolate the conductive shield of the cable from the center conductor of the cable within the connector. Additionally, o-rings may be included to provide the connector with moisture and dust protection and to minimize RF signal loss. The coaxial cable connectors are relatively expensive and are cumbersome to assemble.

Snap together connectors, such as those described in U.S. Pat. Nos. 4,834,675 and 4,902,246 to Samchisen, are known in the art and are known as Snap-n-Seal connectors. The Snap-n-Seal connectors are easily assembled, having a sleeve which is snap fit into a collar. The Snap-n-Seal connectors include o-rings for sealing out moisture and are comprised of a metallic post, collar, sleeve and nut.

U.S. Pat. No. 5,470,257 to Szegda also describes a snap together connector. The Szegda connector also includes o-rings for sealing out moisture and are comprised of a metallic post, collar, nut and sleeve.

SUMMARY OF THE INVENTION

A low-cost, snap together CATV connector for indoor use is presented. The connector includes a post made of electrically conductive material, such as brass. The connector further includes a threaded nut, sleeve and collar made from a low-cost material such as plastic. The collar is fit onto the post, and the threaded nut is rotatable about one end of the post. A prepared end of a coaxial cable is inserted through the sleeve, and integrated with the post. The sleeve is then snap fit within the collar. Accordingly, the coaxial cable shield and jacket are mechanically secured to the connector between the post and the sleeve. Additionally, a secure electrical connection is made between the coaxial cable shield and the post. The connector can then be placed on a cooperating connector, and the threaded nut hand tightened to secure the connector to the cooperating connector. The connector is intended for indoor use, therefore there is no need to provide the connector with o-rings or other sealing elements. While the cost of the connector is kept minimal by the use of plastic parts and the elimination of the o-rings, the performance of the connector still meets or exceeds SCTE standards.

BRIEF DESCRIPTION OF THE DRAWINGS

The invention will be more fully understood from the following detailed description taken in conjunction with the accompanying drawings in which.

DESCRIPTION OF THE PREFERRED EMBODIMENT

Figure 1:
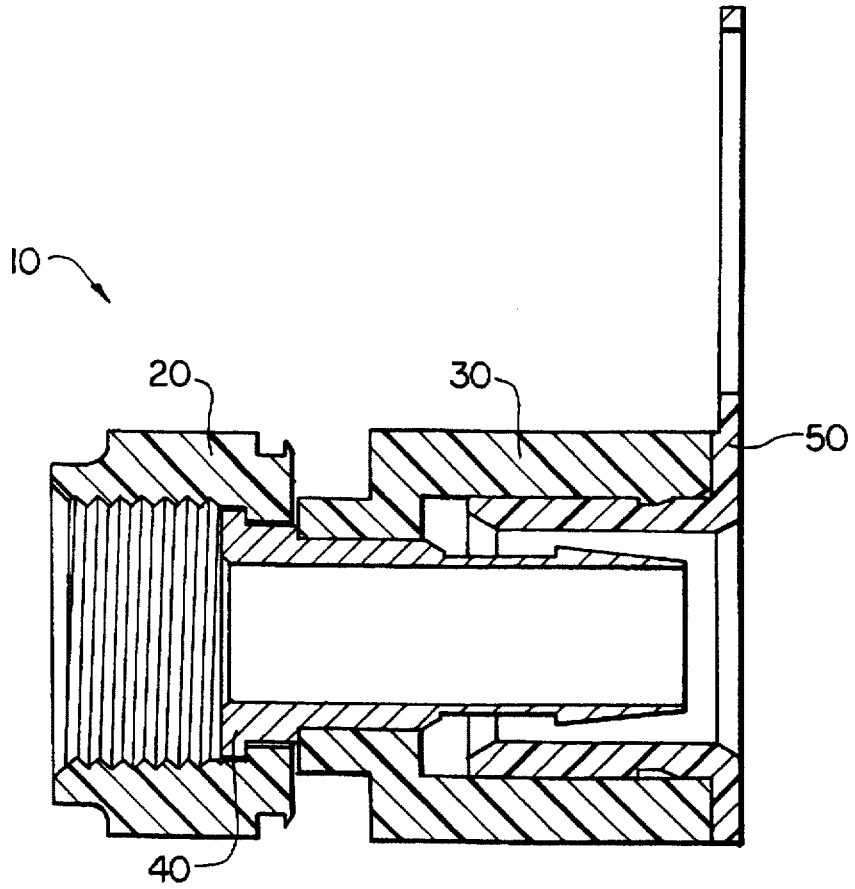
FIG. 1 is a cross-sectional diagram of the connector of the present invention.
Figure 1A:
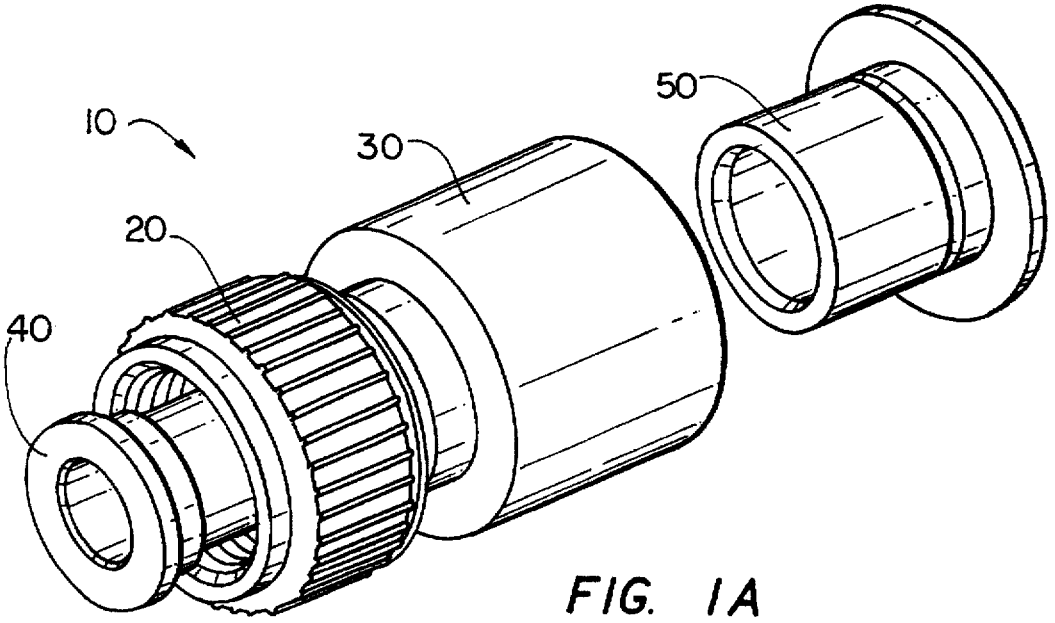
FIG. 1A is an exploded isometric view of the connector of FIG. 1.

FIGS. 1 and 1A show a low cost snap-together CATV connector 10 intended for indoor use, according to the present invention. The connector comprises a central post 40 press fit into a collar 30. A threaded nut 20 is rotatably disposed at a distal end of the central post 40. A sleeve 50 is adapted to be snap fit into the proximal end of the collar 30, and provides for secure mechanical and electrical connection of the connector onto a prepared end of a coaxial cable.

Figure 2:
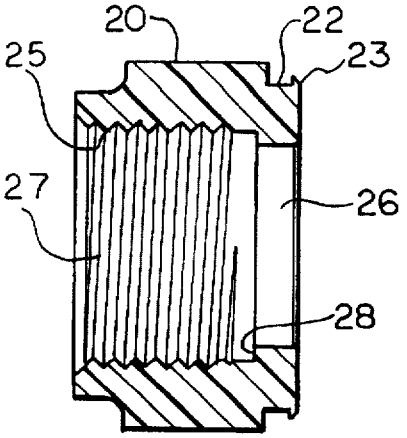
FIG. 2 is a cross-sectional diagram of the nut of the connectors.
Figure 2A:
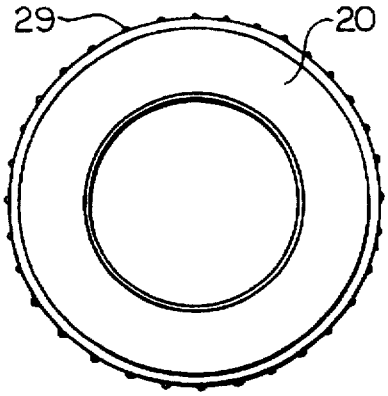
FIG. 2A is an end view of the nut of FIG. 2.

Referring now to FIGS. 2 and 2A, threaded nut 20 is shown in detail. Nut 20 is made of a low cost material such as plastic. The plastic may be nylon. Nut 20 includes a first central bore 27 extending a predetermined distance therein. Threads 25 are provided along the internal surface of the first central bore 27. The threads 25 are provided to allow the connector 10 to be threadably received by a cooperating cable connector (not shown).

Nut 20 also includes a second bore 26 having a smaller diameter than the first bore 27. Second bore 26 extends from the second end of the nut 20 into first bore 27 and provides an annular shoulder 28. Optionally, an annular groove 22 for retention of a retaining ring (not shown) is provided about an exterior surface of the nut adjacent the second end of the nut. A tapered lip 23 may also be provided to allow for easier insertion of the retaining ring into the groove 22. Shown in FIG. 2A are knurls 29, which allow for the user to sufficiently hand tighten the nut 20 onto the cooperating cable connector mentioned above.

Figure 3:
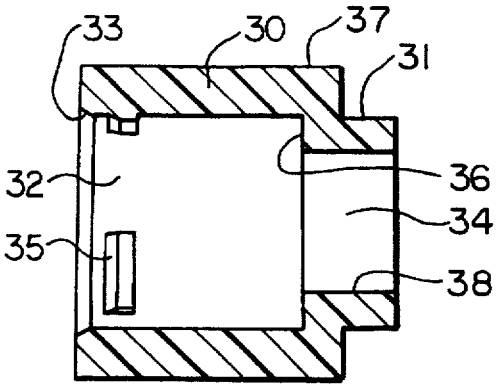
FIG. 3 is a cross-sectional view of the collar of the connector.
Figure 3A:
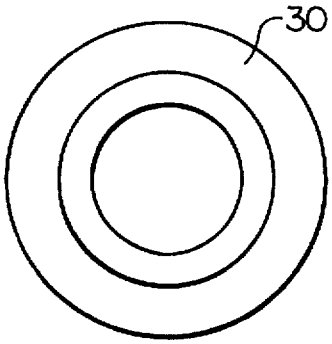
FIG. 3A is an end view of the collar of FIG. 3.

Connector 10 also includes a collar 30, shown in FIGS. 3 and 3A. Collar 30 is made of a low cost material such as plastic. The plastic may be nylon. Collar 30 includes a first central bore 32 extending from a first end of the collar a predetermined distance into said collar. Engagement teeth 35 are provided along the internal surface of the first central bore 32. While multiple teeth are shown, a single tooth could be utilized, as could a ridge extending annularly within the central bore 32.

Collar 30 also includes a second bore 34 having a smaller diameter than the first bore 32. Second bore 34 extends from the second end of the collar 30 into the first bore 32, thereby providing an annular shoulder 36. Second bore 34 includes an interior surface 38. The second end of collar 30 has an outside surface 31 that is smaller in diameter than the remaining outside surface 37 of collar 30. A tapered edge 33 may also be provided at the first end of first central bore 32 to allow for easier insertion of a portion of a sleeve (not shown) into the first bore 32.

Figure 4:
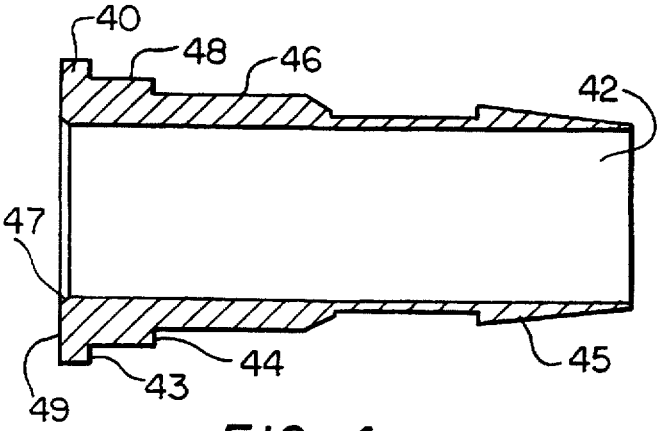
FIG. 4 is a cross-sectional diagram of the post of the connector.
Figure 4A:
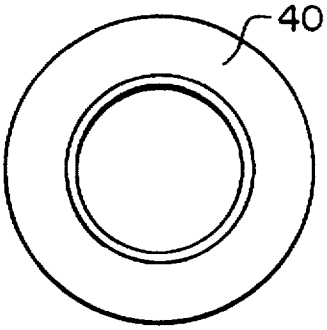
FIG. 4A is an end view of the post of FIG. 4.

Connector 10 is also provided with a tubular post 40, shown in FIGS. 4 and 4A. Post 40 is comprised of brass or other electrically conductive material. Post 40 includes a bore 42 disposed therethrough. Bore 42 is sized to receive the center conductor and dielectric insulator of a coaxial cable therein when a prepared end of a coaxial cable is inserted into the connector 10. Bore 42 may include a tapered edge 47 at a distal end. Post 40 includes a first stop 43 which cooperates with annular shoulder 28 of nut 20 to secure nut 20 in a rotatable engagement about a first flat annular area 48 of post 40. Post 40 includes a second stop 44 adjacent a second flat annular area 46. Second stop 44 and second flat annular area 46 are joined to the inside surface 38 of collar 30 in a press fit engagement, thus the second flat annular area 46 of post 40 is securely engaged with inside surface 38 of collar 30. The exterior surface 45 of the second end of post 40 is sized to fit between the dielectric insulator and a conductive shield of a coaxial cable when the coaxial cable is inserted into the connector 10. When the nut 20 of the connector 10 is mated with a cooperating cable connector, the distal end 49 of post 40 is brought into electrical communication with the cooperating cable connector, thereby providing a conduction path from the shield of the coaxial cable, through the post 40, to the outside body of the cooperating cable connector.

Figure 5:
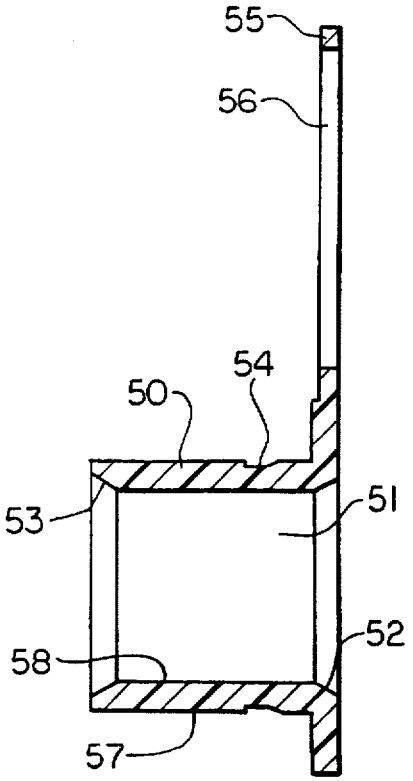
FIG. 5 is a cross-sectional view of the sleeve of the connector.
Figure 5A:
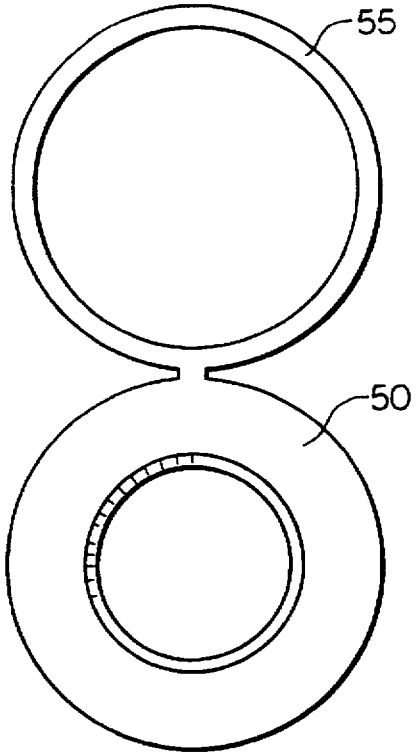
FIG. 5A is an end view of the sleeve of FIG. 5.

The connector 10 further includes a sleeve 50, shown in FIGS. 5 and 5A. Sleeve 50 is made of a low cost material such as plastic. The plastic may be Delrin. Sleeve 50 includes a central bore 51 extending completely therethrough. Central bore 51 may also include tapered ends 52 and 53 which allow for easier insertion and extension of the coaxial cable through the sleeve 50. Sleeve 50 also has an exterior surface 57 which is sized to fit securely within bore 32 of collar 30. Exterior surface 57 further includes an annular groove 54 which is adapted to receive engagement teeth 35 when sleeve 50 is snap fit into collar 30. When sleeve 50 is inserted within collar 30, the coaxial cable is brought into secure mechanical engagement such that the conductive shield of the cable is secured between the outside surface of post 40 and the inside surface 58 of sleeve 50. Post 40 is additionally in electrical communication with the conductive shield of the cable.

Sleeve 50 may also include a retaining ring 55. Retaining ring 55 is integrally formed with sleeve 50. Retaining ring 55 includes a central bore 56 which is sized to fit within the annular groove 22 of nut 20, thereby allowing for the sleeve to be kept together with the connector until the connector is assembled, at which time sleeve 50 is broken away from retaining ring 55. Retaining ring 55 remains seated within annular groove 22 of nut 20.

Figure 6:
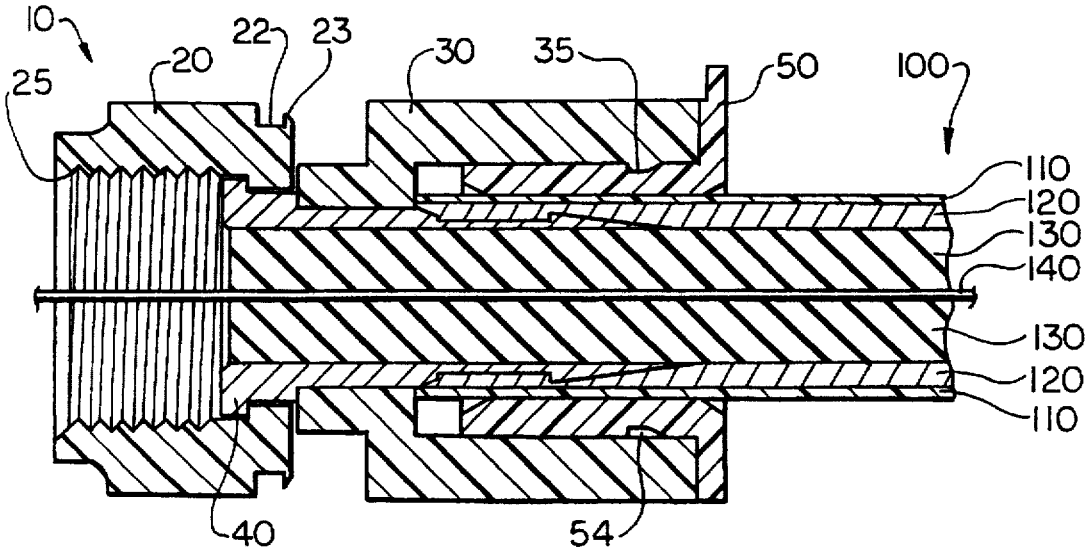
FIG. 6 is a cross-sectional view of the connector having a coaxial cable installed therein.

FIG. 6 shows the connector 10 assembled onto a coaxial cable 100. Coaxial cable 100 comprises a center conductor 140 centrally disposed within the cable. The center conductor is surrounded by a dielectric insulator 130. A conductive shield 120 surrounds the dielectric insulator 130, and a jacket 110 surrounds the shield 120.

In order to assemble the connector 10 onto a coaxial cable 100 the following steps are performed. A first end of coaxial cable 100 is prepared. One end of the coaxial cable 100 is stripped such that an end portion of the jacket 110 and shield 120 are removed, exposing an end section of dielectric insulator 130. An end portion of the exposed dielectric insulator is removed to expose a section of center conductor 140. The prepared end of coaxial cable 100 is inserted through bore 51 of sleeve 50. The prepared end of the coaxial cable 100 is then inserted into connector 10 such that center conductor 140 and dielectric insulator 130 are positioned inside the center bore of post 40. The center conductor 140 extends completely through the post 40. The dielectric layer 130 extends completely within post 40 and insulates center conductor 140 from post 40. Conductive shield 120 extends along an outer surface of post 40 and is in electrical communication with post 40. Jacket 110 and conductive shield are mechanically secured between post 40 and sleeve 50 when sleeve 50 is snap fit into collar 30.

Alternate embodiments may include any of the nut, collar and sleeve comprised of a conductive material such as a conductive plastic, metal plated plastic or other conductive materials as are known in the art. While o-rings are not implemented, they could be utilized if dust, humidity, RF signal loss or other factors are a concern.

By implementing low cost parts and removing the requirement of o-rings between different sections of the connector, the cost of the connector is minimized while performance of the connector meets or exceeds acceptable levels.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

We claim:

1. A CATV connector for indoor use consisting of:

a post of electrically conductive material having a first open end and a second open end, and a bore centrally disposed therethrough;

a nut having a first open end and a second open end, a bore centrally disposed therethrough, and threads on an internal surface adjacent the first end thereof;

said nut disposed coaxially around and rotatable about a portion of the post;

a collar of electrically insulative material having a first open end and a second open end, a bore centrally disposed therethrough, and an engagement element disposed along an interior surface thereof;

said collar disposed along a common longitudinal axis with said connector, said collar attached to a portion of said post such that the first end of said collar is adjacent the second end of said nut; and a sleeve of electrically insulative material having a first open end and a second open end, a bore centrally disposed therethrough, and a receiving element configured to receive said engagement element of said collar when said sleeve is fit into said collar.

2. The connector of claim 1 wherein said engagement element comprises an annular ridge.

3. The connector of claim 1 wherein said post further includes a tapered end.

4. The connector of claim 1 wherein said sleeve includes a retaining ring.

5. The connector of claim 1 wherein said nut includes an annular groove sized to receive said retaining ring.

6. The connector of claim 1 wherein said nut further includes a plurality of knurls on an external surface thereof.

7. The connector of claim 1 wherein said electrically conductive material comprises brass.

8. The connector of claim 1 wherein said central bore of said post receives a conductor of a coaxial cable therethrough, said post receives a dielectric of the coaxial cable therein, said sleeve receives a conductive shield and a jacket of the coaxial cable therethrough, and wherein when said sleeve is fit within said collar the shield and the jacket of the coaxial cable are secured within said connector between said post and said sleeve with said post in electrical communication with the shield.

9. The connector of claim 1 wherein said collar and said nut are comprised of nylon, and said sleeve is comprised of Delrin.

10. The connector of claim 1 wherein said electrically insulative material comprises plastic.

* * * * *